US006962735B2

(12) United States Patent
Li et al.

(10) Patent No.: US 6,962,735 B2
(45) Date of Patent: Nov. 8, 2005

(54) TEXTILE PRINTING SUBSTRATE

(75) Inventors: Shulong Li, Spartanburg, SC (US); Anthony S Brandon, Moore, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 09/943,920

(22) Filed: Aug. 31, 2001

(65) Prior Publication Data

US 2003/0118786 A1 Jun. 26, 2003

(51) Int. Cl.[7] ..... B41M 5/40

(52) U.S. Cl. ..... 428/32.16; 428/32.29; 428/32.3; 428/32.35

(58) Field of Search ..... 428/32.16, 32.29, 428/32.3, 32.35, 195, 206, 311.51

(56) References Cited

U.S. PATENT DOCUMENTS

| | | | | | |
|---|---|---|---|---|---|
| 3,382,096 | A | | 5/1968 | Boardman | 117/139.5 |
| 4,224,026 | A | | 9/1980 | Reinhardt | 8/532 |
| 4,330,293 | A | | 5/1982 | Lindermann | 8/495 |
| 4,554,181 | A | | 11/1985 | Cousin et al. | 427/261 |
| 4,599,807 | A | | 7/1986 | Wells et al. | 34/9 |
| 4,702,742 | A | | 10/1987 | Iwata et al. | 8/495 |
| 4,718,918 | A | | 1/1988 | Heller et al. | 8/495 |
| 5,024,674 | A | | 6/1991 | Prelini et al. | 8/554 |
| 5,087,266 | A | | 2/1992 | Connell et al. | 8/109 |
| 5,165,973 | A | | 11/1992 | Kojima et al. | 428/331 |
| 5,169,441 | A | | 12/1992 | Lauzon | 106/416 |
| 5,180,624 | A | | 1/1993 | Kojima et al. | 428/211 |
| 5,212,008 | A | | 5/1993 | Malhotra et al. | 428/216 |
| 5,279,885 | A | | 1/1994 | Ohmori et al. | 428/195 |
| 5,348,557 | A | | 9/1994 | Von der Eltz et al. | 8/188 |
| 5,372,884 | A | | 12/1994 | Abe et al. | 428/331 |
| 5,645,631 | A | | 7/1997 | Koike et al. | 106/31.36 |
| 5,677,067 | A | | 10/1997 | Kojima et al. | 428/478.2 |
| 5,747,146 | A | | 5/1998 | Kashiwazaki et al. | 428/206 |
| 5,783,038 | A | | 7/1998 | Donigian et al. | 162/135 |
| 5,847,740 | A | | 12/1998 | Yamamoto et al. | 347/106 |
| 5,854,649 | A | | 12/1998 | Koike et al. | 347/106 |
| 5,856,001 | A | | 1/1999 | Okumura et al. | 428/331 |
| 5,888,625 | A | | 3/1999 | Kobayashi et al. | 428/195 |
| 5,897,694 | A | | 4/1999 | Woolf | 106/31.27 |
| 5,912,085 | A | | 6/1999 | Ito et al. | 428/500 |
| 5,958,561 | A | * | 9/1999 | Held | 428/207 |
| 5,965,244 | A | | 10/1999 | Tang et al. | 428/195 |
| 6,001,137 | A | | 12/1999 | Alfekri et al. | 8/445 |
| 6,001,995 | A | | 12/1999 | Schrell et al. | 536/111 |
| 6,020,032 | A | | 2/2000 | Romano, Jr. et al. | 427/411 |
| 6,025,068 | A | | 2/2000 | Pekala | 428/315.5 |
| 6,028,028 | A | | 2/2000 | Nitta | 503/200 |
| 6,096,469 | A | | 8/2000 | Anderson et al. | 430/119 |
| 6,103,364 | A | | 8/2000 | Harris et al. | 428/326 |
| 6,129,785 | A | | 10/2000 | Schliesman et al. | 106/482 |
| 6,139,940 | A | * | 10/2000 | Iwamoto et al. | 428/195 |
| 6,140,406 | A | | 10/2000 | Schliesman et al. | 524/493 |
| 6,171,444 | B1 | | 1/2001 | Nigam | 162/158 |
| 6,183,851 | B1 | * | 2/2001 | Mishima | 428/32.34 |
| 6,197,383 | B1 | | 3/2001 | Nigam | 427/391 |
| 6,197,880 | B1 | | 3/2001 | Nigam | 524/845 |
| 6,241,787 | B1 | | 6/2001 | Nigam | 8/543 |
| 6,291,023 | B1 | * | 9/2001 | Nigam | 427/389.9 |
| 6,326,323 | B1 | | 12/2001 | Shimano et al. | 442/76 |
| 6,342,273 | B1 | * | 1/2002 | Handels et al. | 427/475 |
| 6,343,273 | B1 | | 1/2002 | Nahan et al. | 705/5 |
| 6,372,031 | B1 | | 4/2002 | VanDahm et al. | 106/31.64 |
| 6,387,473 | B1 | | 5/2002 | Martinez-Bustos et al. | 426/622 |
| 6,472,051 | B2 | | 10/2002 | Hirabayashi et al. | 428/195 |
| 6,478,980 | B2 | | 11/2002 | Nigam | 252/8.61 |
| 6,541,567 | B1 | | 4/2003 | Riku et al. | 525/70 |

FOREIGN PATENT DOCUMENTS

| | | | | |
|---|---|---|---|---|
| EP | 0 896 883 A1 | * | 2/1999 | B41M/5/00 |
| WO | WO02/36354 | | 5/2002 | B41M/5/00 |
| WO | 03/020502 | | 3/2003 | B32B/3/00 |

OTHER PUBLICATIONS

Modification of cotton to improve its deyability. Part 1–pretreating cotton with reactive polyamide–epichlorohydrin resin; Burkinshaw and Lewis; Department of Colour Chemistry and Dyeing, University of Leeds, Leeds LS2 9JT; JSDC vol. 105 Nov. 1989 pp. 391–398.

Pretreatment of Woo/Cotton for Union Dyeing Part 2: Fiber Reactive Quaternary Ammonium Compounds; Cardamone, Bao, Marmer, Bulan–Brady, and Dudley; Textile Chemist and Colorist; Dec. 1996 pp. 19–24.

Copending U.S. Appl. No. 10/268,537; filed Oct. 10, 2002; entitled "Printed Textile"; Milliken File No. 5519 a copy of which is hereby enclosed with this statement.

Copending U.S. Appl. No. 10/268,320; filed Oct. 10, 2002; entitled "Textile Printing Substrate"; Milliken File No. 5436 a copy of which is hereby enclosed with this statement.

Copending U.S. Appl. No. 09/943,919; filed Aug. 31, 2001; entitled "Printed Textile Substrate"; Milliken File No. 5312 a copy of which is hereby enclosed with this statement.

PCT International Search Report; PCT/US02/27759; International Filing Date Aug. 29, 2002.

* cited by examiner

*Primary Examiner*—B. Shewareged
(74) *Attorney, Agent, or Firm*—Terry T. Moyer; Jeffery E. Bacon

(57) ABSTRACT

A textile substrate is treated with a composition having a dye fixing agent and an ink receiving agent, for the subsequent printing with an ink jet printer. The dye fixing agent includes a reactive amino compound, and the ink receiving agent comprises inorganic particles. A resin binder can also be used where the dye fixing agent does not provide an adequate bond to the textile substrate.

15 Claims, No Drawings

TEXTILE PRINTING SUBSTRATE

BACKGROUND

The present invention generally relates to the printing of textiles.

Due to the many various types of textile substrates that printing is performed on, and the many various types of printing inks, is often difficult to obtain consistency in the quality of the print between printed textiles. These complications are magnified by the difficulty of obtaining a quick drying, sharp focused print on textile materials in general. Additionally, pigment based inks require additional binders, and most dyes require an additional dye fixing process when printing on a textile.

Therefore, there is a need for materials that allow the printing on various different types of textiles with various different types of printing inks thereon, enhance the fast pickup of the ink on the textile and help in obtaining sharp well defined patterns, and assist in the reduction of the need for special binders or fixing processes for printing on textiles.

DETAILED DESCRIPTION

The present invention is directed to the treatment of a textile substrate for the subsequent reception of a printing ink, such as ink from an ink jet printer. In one embodiment, the treatment of the present invention includes the placement of a treatment of a dye fixing/receiving composition on the surface of the textile substrate which is to receive the printed ink, prior to placement of the printing ink on the textile substrate. The dye fixing/receiving composition generally includes a dye fixing agent and an ink receiving agent. In one embodiment, the dye fixing/receiving compound can include a compatible resin binder. Additional additives can be used with the dye fixing/receiving composition, such as whitening agents, antimicrobial agents, and light stabilizers/UV absorbers. In another embodiment, the treatment of the present invention includes the placement of a UV absorber on the surface of the textile substrate which is to receive the printed ink, prior to placement of the printing ink on the textile substrate.

The textile substrate contributes to whiteness, texture, and physical porous structure for holding the ink. The textile substrate can be a knit, woven, nonwoven, or similar type textile. In one embodiment, the textile substrate is a tight woven fabric. It has been found that textile substrates formed of dull white opaque textured or spun yarns provide a good substrate for the present invention. For example, tightly woven fabrics from cotton staple yarns provide opacity and absorbency that assists in the functions of the treatment of the textile substrate. The material of the textile substrate can be synthetic, natural, or regenerated. In most cases, it is the treatment that receives a majority of the dyes in the ink. It has been found that the present invention with a bright white substrate provides better brightness and contrast for the resulting image on the textile.

The dye fixing/receiving composition of the present invention includes a dye fixing agent and an ink receiving agent. In one embodiment, the fixing agent has a molecular weight of at least about 1000. The fixing agent of the present invention comprises reactive amino compounds of a highly cationic nature. A preferred reactive amino compound is a compounds having a high positive charge density (i.e., at least two (2) milliequivalents per gram). Reactive amino compounds that can be used in the present invention include compounds containing at least one primary, secondary, tertiary, or quaternary amino radical. Additionally, the reactive amino compounds can contain a reactive group that is capable of reacting with the textile substrate or resin binder to form a bond thereto. Examples of a reactive group include epoxide, isocyanate, vinylsulphone, and halo-triazine. Ink receiving agents of the present invention are inorganic particles that receive the ink through adsorbancy or absorbancy. In one embodiment, the particle size of the ink receiving agent is equal to, or less than, about 10 microns. In another embodiment, the particle size of the ink receiving agent is equal to, or less than, about 3 microns. In yet another embodiment, the particle size of the ink receiving agent is equal to, or less than, about 1 micron. Examples of ink receiving agents of the present invention include silica, silicate, calcium carbonate, aluminum oxide, aluminum hydroxide, and titanium dioxide.

In one embodiment, the fixing agent typically will comprise from about 0.2% to about 20% by weight of the treated textile substrate. In one embodiment, the ink receiving agent typically will comprise from about 0.2% to about 20% by weight of the treated textile substrate. Preferably, the dye fixing/adsorbing composition comprises from about 1% to about 5% of the treated textile substrate. The fixing agent typically will comprise from about 0.2% to about 20% by weight of the treated textile substrate. Prior to placement on the textile substrate, the dye fixing/receiving composition is preferably in the form of a stable aqueous solution or dispersion.

In the embodiment using a resin binder, the resin binder must be a binder that will have good a bond with the fiber of the textile substrate. The resin binder can be a thermoplastic or thermosetting polymeric binder. It is preferable that the resin binder has a glass transition temperature of below about 40° C. It is also preferred that the binder be durable when subjected to washing. Examples of resin binders include non-anionic or cationic latices, such as ethylenevinylacetate, acrylic, urethane polymer, polyamide, and polyester. In one embodiment, the resin binder comprises up to about 10% of the weight of the treated substrate.

Whitening agents can include white pigments and optical brighteners. White pigments provide an improved white background for the inks and dyes placed on the textile substrate, thereby increasing the contrast of the image on the textile substrate. Examples of white pigments would include zinc oxide and titanium oxide. Optical brighteners having photo-luminescent properties brighten the background of the textile substrate to provide a greater contrast with the inks and dyes placed on the textile substrate. Examples of optical brighteners could include stylbene based materials such as Leucophor from Clariant Corporation.

An antimicrobial agent inhibits the growth of microorganisms, such as bacteria, fungi, or the like, which can cause discoloring of an image on the textile substrate and/or degradation of the textile substrate itself. The antimicrobial agent can be an additive which is compatible with the cationic fixing agents, and is durable to weathering. Examples of suitable antimicrobial would include polyguanidine, silver zirconium phosphate, and quaternary aminosilane.

Light stabilizers are materials that contribute to stabilizing the colorants in the printed ink and textile substrate. Examples of light stabilizers could include hindered amines and hindered phenol, such as Cyasorb 3346 by Cytec Industries and Irganox by Ciba Specialty Chemicals.

UV absorbers are materials that strongly absorb harmful UV radiation, thereby reducing the exposure of the colorants in the printed ink from the harmful UV radiation. In one embodiment, the UV absorber comprises from about 0.1% to about 10% of the weight of the treated textile substrate. Traditionally, it was believed that the UV absorbers needed to be applied with the ink or cover the ink as a post treatment to provide protection. However, a surprising discovery of the present invention is that placement of the UV absorber on the textile before printing of the ink, provides an unexpected result of improved light fastness. Examples of UV absorbers can includes benzyltriazoles, hydroxylphonones, and Dihydroxygybenzylphenone, such as Tinuvin 1130 by Ciba Specialty Chemicals.

The treatment can be applied to the textile substrate by dipping, coating, spraying, powder coating, hot melt coating, and other similar methods. The treatment can be applied to the textile substrate in a single application, or multiple applications. Additionally, the various components of the treatment can be applied together, in particular groupings, or individually. In one embodiment, the treatment is applied to the substrate textile by impregnation or coating, which is then followed by a drying process.

In the embodiment of the treatment having reactive amino compounds, the drying process is typically conducted under an elevated temperature to activate the reactive amino compounds of the dye fixing agent for bonding with the textile substrate and/or the resin binder. An elevated temperature for the drying process is a temperature that accelerates the evaporation of solvents in the treatment and the reaction of the reactive amino compound. Typically, an elevated temperature for the drying process would be from about 100° C. to about 150° C.

The designs or images are placed on the treated surface of the substrate. In one embodiment, the design or image is placed on the treated substrate by an ink jet printer, such as the type for home, office, or commercial uses. It has been found that the present invention works well when the printing ink contains an acid dye, a reactive dye, a direct dye, or similar anionic colorants. It has also been found that by ironing the print on the textile substrate with or without steam, or by drying the printed article in a home dryer, the color fastness of the printed article may be improved.

It is believed that the dye fixing agent interacts with the ionic dyes from an ink jet printer ink in a charge type attraction, and that the dye fixing agent of the present invention typically will react with the fiber of the textile substrate to form a chemical bond with the textile substrate. In an embodiment where a resin binder is used, it is believed that the dye fixing agent will chemically bond with the resin binder, which bonds with the textile substrate. It is also believed that the ink receiving agent provides surface area for the ink from the ink jet printer to interact with the dye fixing agent, thereby facilitating the effects of the dye fixing agent. The interaction of the dye fixing agent and the ink receiving agent provide a surprising result in an improved color yield and image wash durability. The use of the dye fixing/receiving composition as the treatment in the present invention, provides a wash durable and crocking resistant print with little, or no, subsequent fixing procedures or chemical treatment.

The present invention allows well defined pixels to form and facilitates the drying process of the print. The present invention improves the quality of the printed image while preserving the flexible hand of the underlying textile substrate. The present invention also allows the use of various different types in inks various different types of substrate textiles.

The print exhibits good crocking resistance and water fastness within a few minutes after printing. The article with the image can also withstand repeated laundry cycles with little color fade. It has been discovered that the present invention works well when the pH of the laundry detergent is in the range of from about 4 to about 8.

The present invention can be better understood with reference to the following examples:

EXAMPLE 1

A treatment mixture containing a reactive dye fixing agent, Kymene 736 (manufactured by Hercules, Wilmington, Del.), a inorganic silica particle dispersion, Ludox CL-P (manufactured by W. R. Grace & Co., Columbia, Md.), and a ethylene vinylacetate latex binder, Airflex TL-51 (manufactured by Air Products and Chemicals, Inc., Allentown, Pa.) was made according to the following formula:

| | |
|---|---|
| Ludox CL-P | 8 parts by weight |
| Kymene 736 | 12 parts by weight |
| Airflex TL-51 | 4 parts by weight |
| Water | 76 parts by weight |

A small amoung of ammonia hydroxide solution was added to adjust the pH to 11.

A woven cotton fabric (cotton Poplin), a plain woven polyester fabric with textured yarns, and a plain woven 50/50 polyester/cotton fabric were separately impregnated with the above treatment solution, passing through nip rolls to get a wet pickup of about 60%. The impregnated fabrics were dried in a convection oven at 300° F. for 3 minutes.

All those treated fabrics were printed with solid circles and squares of 3 primary colors (red, blue, yellow) and black using Hewlett Packard DeskJet 932C ink jet printer. All treated fabric showed very good sharpness at the edges and excellent color holdout. There was no evidence of ink feathering. The printed fabrics were then washed in a regular home washer using delicate cycle using Gentle Cycle Woolite neutral detergent following AATCC Standardization of Home Laundry Text Condition (Developed in 1984 by AATCC Committee RA88, and as revised in 1986,1992, and 1995.). Fabrics were then dried in a regular home dryer at low heat for 20 minutes. Very little color loss was observed after the washing. No color bleeding or migration was observed. Color value (CIE L*, a* and b* values) of each of the colors on the printed fabrics after one wash and five washes was measured using an X-Rite SP78 Spectrophotometer utilizing the QA Master software for Microsoft Windows Version 1.71 (both manufactured by X-Rite Inc., Grandville, Mich.). E versus the color printed on a piece of white paper was used to measure the degree of color loss. Wet crocking (AATCC test method 8–1996), and waterfastness (AATCC test method 107–1997) were also measured on each primary color on the fabric after one wash. The test results are summarized in Table 1 and Table 2.

TABLE 1

| | Test Values After One Wash | | | |
|---|---|---|---|---|
| | Black | Yellow | Red | Blue |
| COTTON | | | | |
| ΔE vs. paper | 2.05 | 18.41 | 7.20 | 8.21 |
| Wet Crocking* | 1 | 4 | 4 | 3 |
| Water Colorfastness* | 5 | 5 | 5 | 5 |
| 50/50 COTTON/PET | | | | |
| ΔE vs. paper | 3.35 | 26.31 | 14.17 | 9.00 |

TABLE 1-continued

| Test Values After One Wash | Black | Yellow | Red | Blue |
|---|---|---|---|---|
| Wet Crocking* | 1 | 2.5 | 3 | 3 |
| Water Colorfastness* | 5 | 5 | 5 | 5 |
| PET | | | | |
| ΔE vs. paper | 2.74 | 39.27 | 23.00 | 12.80 |
| Wet Crocking* | 1.5 | 3 | 1.5 | 2.5 |
| Water Colorfastness* | 5 | 5 | 5 | 5 |

*AATCC Grey Scale for Staining

TABLE 2

| Test Values After Five Washes | | | | |
|---|---|---|---|---|
| Color | Black | Yellow | Red | Blue |
| COTTON | | | | |
| ΔE vs. paper | 0.63 | 5.67 | 5.25 | 4.96 |
| 50/50 COTTON/PET | | | | |
| ΔE vs. paper | 8.62 | 11.20 | 9.73 | 9.06 |
| PET | | | | |
| ΔE vs. paper | 5.40 | 14.82 | 11.73 | 9.92 |

*AATCC Grey Scale for Staining

EXAMPLE 2

Same fabrics used as in Example 1 without treatment were printed using the same printer with the same prints as a control example. A significant ink feathering on polyester fabric and a small degree of ink feathering on 50/50 polyester cotton blend fabric were observed. Lower color yield was observed on all the fabrics compared with treated fabrics. After one home wash as described in Example 1, there was very little color remained on the fabric, as evidenced by the E values measured on each color.

EXAMPLE 3

Similar formula as in Example 1, was used except that Ludox CP-L was not included. The same cotton woven cotton fabric as in Example 1 was treated in the same manner as in Example 1. Print quality and color fastness was measured. The color yield is lower and the print is not as wash fast as treated cotton in Example 1.

EXAMPLE 4

Similar formula as in Example 1 was used except that Kymene 736 was not included. The same cotton woven cotton fabric as in Example 1 was treated in the same manner as in Example 1. Print quality and color fastness was measured. The color yield is significantly lower and dramatic color loss was observed after one wash.

EXAMPLE 5

Similar formula as in Example 1 was used except that 1 gram of Reputex 20 (antimicrobial agent manufactured by Avecia Biocides, Wilmington, Del.) was added. Cotton fabrics treated in Example 1, untreated same fabric and cotton fabric treated with formula in this example were tested for antimicrobial performance. Antibacteria test using AATCC test method 100 conducted and are shown in Table 3. A antifungal test using ISO 846 Test method were conducted and the results are shown in Table 4. Cotton fabric treated with formula containing Reputex 20 showed excellent antibacteria and antifungal performance. *Aspergillus niger* is one of the most common fungus that causes mildew staining. *Chaetomium globosum* is one fungus that can grow on cellulosic material and therefore can biologically degrade and destroy cotton fabric. Treatment containing Reputex 20 therefore can help prevent mildew staining and biological degradation of cotton fabric.

TABLE 3

| Antibacteria Test Against Staphylococcus | |
|---|---|
| Test Sample | Log Reduction |
| Cotton Fabric Without Treatment | 1.37 |
| Cotton Fabric In Example 1 | 0.57 |
| Cotton Fabric In Example 5 | 4.40 |

TABLE 4

| Antifungal Test* | | |
|---|---|---|
| Test Sample | *Aspergillus Niger* | *Chaetomium Globosum* |
| Cotton Fabric Without Treatment | 10/10 | 10/10 |
| Cotton Fabric In Example 1 | 10/10 | 1/10 |
| Cotton Fabric In Example 5 | 0/10 | 1/10 |

*Number of drops of standard fungus solution showing growth out of 10 drops of inoculum after one week.

EXAMPLE 6

Similar formula as in Example 1 was used except that 1 gram of Sunlife LPS-911 (UV absorber manufactured by Nicca USA, Fountain Inn, S.C.) was added. Cotton fabric was treated and printed as described in example #1. Xenon lightfastness (AATCC test method 16–1998) at 20 hours exposure were tested and compared with treated cotton in Example 1 and printed paper, and the results are summarized in Table 5. Lightfastness was improved using the formula containing UV absorber. It is somewhat surprising as the colorants were applied on top UV absorber treatment. We believe that some of the UV absorber must have migrated towards the surface and/or the dyes in the printing ink migrate beneath the treatment.

TABLE 5

| Light Fastness | | | | | |
|---|---|---|---|---|---|
| Test Sample | Black | Yellow | Red | Blue | Average |
| Paper | 5.0 | 4.5 | 2.5 | 1.5 | 3.4 |
| Cotton Fabric In Example 1 | 5.0 | 1.0 | 1.0 | 1.5 | 2.1 |
| Cotton Fabric in Example 6 | 5.0 | 4.0 | 3.5 | 2.0 | 3.6 |

EXAMPLE 7

The following formula was used to make a viscous mixture:

| | |
|---|---|
| Dispal 11N7-12 (aluminum oxide dispersion, Vista Chemical | 40 parts |

-continued

| | |
|---|---|
| Company, Houston, Texas) | |
| Kymene 736 | 5 parts |

The above mixture was then knife coated on one side of a cotton woven fabric and dried at 300 F. for 3 minutes. A test print similar to those used in example was printed on the treated fabric and the printed fabric was washed once using neutral detergent. The color yield and washfastness is virtually the same as treated cotton fabric described in Example 1.

EXAMPLE 8

The following formula was used as a treatment on a woven Poplin cotton fabric:

| | |
|---|---|
| Epi-rez 6006-w-70 (waterborne epoxy resin, by Shell Chemical Company, Houston Texas) | 4 parts |
| Ancamide 500 | 4 parts |
| Ludox Cl-P | 10 |
| Water | 82 parts |

Epi-rez acts both as resin binder and reactive agent that couples with Ancamide (amino compound containing both primary and secondary amines) to generate a durable amine containing finish. The cotton fabric was treated using this formula in the same manner as described in Example 1, and printed and test in the same manner.

What is claimed is:

1. A textile printing substrate comprising:

a textile substrate having a first side and a second side;

a dye fixing/receiving composition disposed on the first side of the textile substrate, the dye fixing/receiving composition including:

a reactive amino compound having a positive charge density of at least two milliequivalents per gram and including a quaternary amino radical and a reactive group, the reactive amino compound being reactively bonded to the textile substrate; and, inorganic particles, said inorganic particles having aluminum or alumina therein; and wherein the dye fixing/receiving composition further comprises an antimicrobial agent.

2. A textile printing substrate comprising:

a textile substrate having a first side and a second side;

a dye fixing/receiving composition disposed on the first side of the textile substrate, the dye fixing/receiving composition including:

a resin binder;

a reactive amino compound having a positive charge density of at least two milliequivalents per gram and including a quaternary amino radical and a reactive group, the reactive amino compound being reactively bonded to the textile substrate;

inorganic particles comprising silica.

3. A textile printing substrate comprising:

a textile substrate having a first side and a second side; and, a dye fixing/receiving composition disposed on the first side of the textile substrate, the dye fixing/receiving composition including:

a resin binder;

a reactive amino compound having a positive charge density of at least two milliequivalents per gram and including a quaternary amino radical and a reactive group, the reactive amino compound being reactively bonded to the textile substrate; and, inorganic particles, said inorganic particles having a particle size of about 1–10 microns.

4. The textile printing substrate of claim 3 further comprising an antimicrobial additive selected from the group of additives consisting of: polyguanidine, silver zirconium phosphate, and quaternary aminosilane.

5. The textile printing substrate of claim 2 further comprising an antimicrobial additive selected from the group of additives consisting of: polyguanidine, silver zirconium phosphate, and quaternary aminosilane.

6. A textile printing substrate comprising:

(a) a textile substrate having a first side and a second side; and, (b) a dye fixing/receiving composition disposed on the first side of the textile substrate, the dye fixing/receiving composition including a reactive amino compound having a positive charge density of at least two milliequivalents per gram and including a quaternary amino radical and a reactive group, the reactive amino compound being reactively bonded to the textile substrate; and (c) inorganic particles, said inorganic particles being selected from the group consisting of: silica, silicate, calcium carbonate, aluminum oxide, aluminum hydroxide and titanium dioxide.

7. The substrate of claim 6, further wherein said inorganic particles are in the size range of about 1–10 microns.

8. The substrate of claim 7 wherein said particles are in the size range of about 3–10 microns.

9. A textile printing substrate comprising:

(a) a textile substrate having a first side and a second side, and (b) a dye fixing/receiving composition disposed on the first side of the textile substrate, the dye fixing/receiving composition including reactive amino compound having a positive charge density of at least two milliequivalents per gram and including quaternary amino radical and a reactive group, the reactive amino compound being reactively bonded to the textile substrate.

10. The substrate of claim 9 wherein the reactive group of the reactive amino compound being selected from the group consisting of: epoxide, isocyanate, vinylsulphone, and halotriazine.

11. The substrate of claim 1 wherein the reactive group of the reactive amino compound being selected from the group consisting of: epoxide, isocyanate, vinylsulphone, and halotriazine.

12. The substrate of claim 2 wherein the reactive group of the reactive amino compound being selected from the group consisting of: epoxide, isocyanate, vinylsulphone, and halotriazine.

13. The substrate of claim 3 wherein the reactive group of the reactive amino compound being selected from the group consisting of: epoxide, isocyanate, vinylsulphone, and halotriazine.

14. The substrate of claim 6 wherein the reactive group of the reactive amino compound being selected from the group consisting of: epoxide, isocyanate, vinylsulphone, and halotriazine.

15. The substrate of claim 9 wherein the reactive group of the reactive amino compound being selected from the group consisting of: epoxide, isocyanate, vinylsulphone, and halotriazine.

* * * * *